United States Patent [19]

Reierson et al.

[11] 4,320,024

[45] Mar. 16, 1982

[54] HYDRAULIC FLUIDS CONTAINING CYANO DERIVATIVES OF CYCLIC KETALS AND ACETALS

[75] Inventors: Robert L. Reierson, Midland, Mich.; Bart J. Bremmer, Ashland; Joseph W. Hanafin, Framingham, both of Mass.

[73] Assignee: The Dow Chemical Company, Midland, Mich.

[21] Appl. No.: 159,332

[22] Filed: Jun. 16, 1980

[51] Int. Cl.[3] ..... C09K 5/00

[52] U.S. Cl. ..... 252/78.3; 252/75; 252/77; 252/78.1; 260/340.7; 260/340.9 R

[58] Field of Search ..... 252/77, 78.3, 78.1, 252/175; 260/340.7, 340.9 R

[56] References Cited

U.S. PATENT DOCUMENTS 3,138,616 6/1964 Scotti et al. ..... 260/340.9 R
3,538,003 11/1970 Lothar ..... 252/77
3,779,930 12/1973 Alcorn et al. ..... 252/77
4,093,554 6/1978 Jayne et al. ..... 252/78.3
4,207,088 6/1980 Konz ..... 260/340.7 X

*Primary Examiner*—P. E. Willis, Jr.
*Attorney, Agent, or Firm*—Douglas N. Deline

[57] ABSTRACT

Hydraulic fluids having high wet equilibrium reflux boiling points, good chemical stability and other desirable characteristics are made from certain cyano-substituted derivatives of cyclic ketals or acetals of the formula

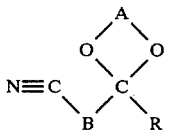

wherein A, B and R are specified radicals.

9 Claims, No Drawings

HYDRAULIC FLUIDS CONTAINING CYANO DERIVATIVES OF CYCLIC KETALS AND ACETALS

BACKGROUND OF THE INVENTION

This invention relates to hydraulic fluids which maintain high wet equilibrium reflux boiling points on exposure to or contamination with moisture. The fluids are used in devices operated by fluid pressure, such as hydraulic brakes, clutches, fluid transmissions, shock absorbers, power steering and control devices for aircraft, ships, automobiles and other vehicles, artillery recoil mechanisms, door checks, jacks and other hydraulic devices adapted for transfer of mechanical energy.

A hydraulic fluid adapted for the above uses must meet a variety of requirements. It should be chemically stable, nearly nonvolatile, and of low flammability, and yet should remain a homogeneous flowable liquid at temperatures as low as −40° C. Additionally, a hydraulic fluid is subject to moisture contamination which may arise because of the inherent hygroscopicity of the hydraulic fluid, from condensation of moisture from the air, or from physical leakage or defects in the hydraulic system that permit water to enter. The deleterious effects arising from moisture contamination of hydraulic fluids include lowering of boiling points, vapor locking, corrosion, hydrolysis, foaming, sludging, freezing, ice crystallization and the like.

Requirements to be met for a satisfactory hydraulic fluid particularly a hydraulic fluid used in motor vehicle hydraulic braking systems have been established by the United States National Highway Safety Bureau and are known generally as DOT 3, DOT 4, and DOT 5 (DOT referring to the Department of Transportation). Included therein are different requirements to be met by proposed hydraulic fluids such as: wet and dry equilibrium reflux boiling point (ERBP), viscosity at −40° C., chemical stability and rubber compatibility standards, etc. A hydraulic fluid satisfying the different testing standards is characterized as being a DOT 3-, DOT 4-, or DOT 5-fluid depending on the particular standard that is met or exceeded by the fluid. Details of this testing procedure are published in the Federal Motor Vehicle Safety Standard, 49 CFR §571.116.

SUMMARY OF THE INVENTION

It has been discovered that hydraulic fluids having good physical characteristics are provided by fluids containing as components thereof cyano derivatives of cyclic ketals and acetals of from 5 to 20 carbons of the formula:

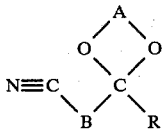

(I)

wherein

R is hydrogen or a monovalent radical of from 1 to 10 carbons selected from branched or linear alkyl, and cyano-, hydroxy-, alkoxy-, acyloxy-, siloxy- or organosiloxy-substituted derivatives thereof;

A is a divalent radical of from 2 to 10 carbons selected from alkylene and alkyl-, aryl-, cyano-, hydroxy-, cyanoalkyl-, hydroxyalkyl-, alkoxy-, polyalkoxy-, acyloxy-, siloxy- or organosiloxy-substituted alkylene; and B is a divalent radical of from 2 to 10 carbons selected from branched or linear alkylene and

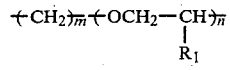

wherein $R_1$ is hydrogen, methyl or ethyl and m and n are integers equal to or greater than 1.

The cyano-substituted cyclic ketals and acetals of the invention have been found to possess desirable qualities making them suited for use in hydraulic fluid formulations. In particular the compounds exhibit high dry and wet equilibrium reflux boiling points as well as low viscosities at −40° C. and good chemical stability. The compounds including mixtures thereof may be combined in major or minor proportion with other hydraulic fluid components and/or additives into hydraulic fluid formulations having qualities tailored for specific applications.

DETAILED DESCRIPTION OF THE INVENTION

The cyano-substituted compounds for use according to this invention may be prepared by several procedures. According to one such procedure a reactive carbonyl- or dialkoxy-containing compound of the formula

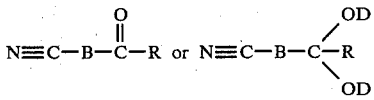

wherein B and R are as previously defined and D is $C_{1-4}$ alkyl is first reacted with an aliphatic diol or polyol. The product is a cyclic ketal or acetal of formula I wherein A is the remnant of the original diol or polyol. Practically any diol or polyol having two hydroxy moieties on adjacent or next adjacent carbon atoms and optionally substituted with the previously named substituents may be employed to produce the compounds of the instant invention. The process is well-known, one similar to it having been previously described in Organic Synthesis, Coll. Vol. 3, 502.

The reaction is carried out in the presence of an acidic catalyst, for example, sulfonic acid, sulfonic acid resin or other strong acid resin that adequately catalyzes this type of reaction. The catalyst may be employed in a molar ratio compared to the cyano-substituted ketone or aldehyde reactant of from about 0.0001/1.0 to about 0.1/1.0. Preferably from 0.001/1.0 to 0.05/1.0.

It is convenient to conduct the reaction in a solvent, preferably such a solvent that easily forms an azeotropic mixture with water allowing the rapid removal of byproduct water formed during the reaction. Further preferred are solvents that do not additionally form azeotropic mixtures with either the cyano-substituted ketone or polyol starting reactants. Suitable solvents include benzene, toluene, petroleum ether, chlorinated aliphatic solvents, etc.

The reaction may also be conducted without a solvent in which case the water or lower alcohol formed during the reaction may be removed by direct distillation preferably at reduced pressure and temperature to limit the formation of oligomers which form at elevated temperatures.

The reaction is conducted at temperatures from about 0° C. to about 200° C. depending on the reactants, pressures and other process conditions employed.

The required reaction time will vary depending on the reactants and temperatures employed. Generally reaction times from about 1 to about 48 hours suffice to convert substantially all of one starting reactant employed in limiting quantities.

Either reactant may be employed in large excess. Molar ratios of cyano-substituted ketone to polyol ranging from about 20/1 to about 1/20 are operable. It is preferred to employ the reactants in nearly equal molar proportions, for example in a molar range from about 2/1 to about ½. Most preferred is a range from about 1.2/1.0 to about 1.0/1.2. An excess of the lower boiling reactant whether polyol or cyano-substituted ketone or aldehyde may be employed to insure complete reaction of the higher boiling reactant. This procedure simplifies the separation of the cyclic ketal or acetal product from reactants by distillation by providing a mixture of components having the maximum possible difference in boiling points.

It is of course equally suitable to add the nitrile substituent to the previously formed cyclic ketals or acetals to produce the desired substituted compounds. Accordingly, a compound containing terminal ethylenic unsaturation but otherwise similar to the previously identified reactive carbonyl- or dialkyl-containing compounds may be reacted with the diol or polyol. When conducted in the presence of hydrogen chloride a chlorinated cyclic ketal is produced which may then be reacted with sodium cyanide in known manner to produce the desired product.

Furthermore, substituents to R or A such as alkoxy, (poly)alkoxy, siloxy, organosiloxy, and acyloxy may be added subsequent to formation of the cyclic ketal or acetal by reaction of suitable reactive precursors with hydroxy-substituted cyclic ketals or acetals formed as above described. By reactive precursors are meant compounds that may be reacted with hydroxyl functionality according to known chemical processes to replace the hydrogen of the hydroxyl functionality. For example, by use of a Williamson synthesis, alkyl and aralkyl moieties may be substituted for hydrogen. Similarly alkylene oxides or mixtures thereof may be used to form ether functionality, producing hydroxy-substituted alkoxy or polyalkyleneoxy substituents which may of course be capped to replace pendant hydroxides with alkyl or aralkyl moieties by means of a Williamson synthesis as previously explained. Acid halides such as acetyl chloride or halo-substituted silanes, organosilanes or organooxysilanes, such as chlorosilane, trimethylchlorosilane or trimethoxychlorosilane, may also be reacted with the hydroxy-containing compounds in the presence of an acid acceptor to produce acyloxy-, siloxy, or organo-substituted siloxy derivatives, respectively. All such substantially inertly-substituted compounds are included within the scope of the instant invention.

Other methods of forming the compounds employed in the present invention may also be utilized without departing from the scope of the invention.

Preferred cyano-substituted compounds of formula I for use as components in hydraulic fluids include 2-cyanoalkyl derivatives of 1,3-dioxolane or 1,3-dioxane. Also preferred are their further ring-substituted alkyl-, hydroxy- or hydroxyalkyl- derivatives. Most preferred cyano-substituted compounds are 2-(2-cyanoethyl)-1,3-dioxolane, 2-(3-cyanopropyl)-1,3-dioxolane, 2-(2-cyanoethyl)-2-methyl-1,3-dioxolane, 2-(3-cyanopropyl)-2-methyl-1,3-dioxolane, 2-(2-cyanoethyl)-4-hydroxymethyl-1,3-dioxolane, 2-(3-cyanopropyl)-4-hydroxymethyl-1,3-dioxolane, 2-(2-cyanoethyl)-2-methyl-4-hydroxymethyl-1,3-dioxolane, 2-(3-cyanopropyl)-2-methyl-4-hydroxymethyl-1,3-dioxolane, 2-(2-cyanoethyl)-4-methyl-1,3-dioxolane, 2-(3-cyanopropyl)-4-methyl-1,3-dioxolane, 2-(2-cyanoethyl)-2,4-dimethyl-1,3-dioxolane, 2-(3-cyanopropyl)-2,4-dimethyl-1,3-dioxolane, 2-(2-cyanoethyl)-5-hydroxyl-1,3-dioxane, 2-(3-cyanopropyl)-5-hydroxyl-1,3-dioxane, and mixtures thereof.

A particularly preferred hydraulic fluid composition having exceptionally high wet equilibrium reflux boiling point and good low temperature viscosity comprises a mixture of cyano-substituted cyclic compounds selected from 2-(2-cyanoethyl)-1,3-dioxolane, 2-(2-cyanoethyl)-4-methyl-1,3-dioxolane, 2-(2-cyanoethyl)-4-hydroxymethyl-1,3-dioxolane and 2-(2-cyanoethyl)-5-hydroxyl-1,3-dioxane. The latter two compounds being formed for example by the reaction of glycerine with β-cyanopropionaldehyde.

As is well-known in the art, suitable qualities for a hydraulic fluid are rarely found in one compound. However, a composition comprising several suitable compounds may be formulated to produce a hydraulic fluid composition having satisfactory properties.

Suitable hydraulic fluids according to the present invention meeting or exceeding DOT 4 requirements comprise the cyano-substituted cyclic compounds of formula (I) present in major or minor proportions, preferably at least about 5 percent by weight. Particular desirable qualities in the hydraulic fluid may be obtained by combining with such compounds additional hydraulic fluid components and/or additives as is well-known in the art. Most preferred according to the invention are fluids consisting essentially of one or more of the cyano-substituted cyclic compounds of formula (I) in an amount from about 10 percent to about 90 percent by weight, one or more hydraulic fluid components in an amount from about zero to about 90 percent by weight and one or more hydraulic fluid additives from about zero to about 10 percent by weight.

By the term "hydraulic fluid component" or simply "component" is meant a solid or liquid chemical compound which when employed as an ingredient in a hydraulic fluid is not substantially chemically reactive with other components or additives or with the cyano-substituted cyclic compounds of the invention and which is substantially immune to decomposition or reaction under the hydraulic fluid operating conditions to which it is exposed and the mechanical systems with which it comes into contact. Particular properties such as boiling point, viscosity, etc., may vary depending on the application for which the hydraulic fluid is used and the operating conditions to which it is exposed. Selection of particular components and mixtures thereof to meet various design criteria may easily be determined by the skilled artisan.

By the term "hydraulic fluid additive" or simply "additive" is meant a solid or liquid chemical compound usually added in a small amount to a hydraulic fluid composition to control or modify various chemical or physical properties of the components of the hydraulic fluid.

Preferred hydraulic fluid components include conventionally known components such as: glycols, glycol ethers including formals, glycol esters, glycol orthoesters, borate esters, silicons, etc.

Specifically, the glycols include (poly)alkylene glycols of the formula $HO\text{-}(R'O)_n\text{—}H$ wherein each R' is the same or different and is a linear or branched $C_{1-6}$ alkylene and n is a positive number up to about 50. Such (poly)alkylene glycol hydraulic fluid components are well-known in the art.

The polyglycol mono- and diethers and formals known as conventional hydraulic fluid components include compounds of the formula $R'_1O\text{-}(R'O)_n\text{—}R_2$ and $R'_1O\text{-}(R'O)_n\text{—}CH_2\text{-}(OR')_n\text{—}OR_2$ wherein R' and n are as previously defined, $R'_1$ is a $C_{1-4}$ linear or branched alkyl, hydrogen or phenyl radical, and $R_2$ is a $C_{1-4}$ linear or branched alkyl or phenyl radical.

The glycol ester conventional hydraulic fluid components include compounds of the formula

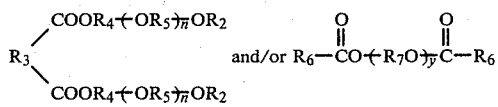

wherein n and $R_2$ are as previously defined, $R_3$ is a straight- or branched-chain alkylene group containing at least 2, preferably 2 to 8, carbon atoms, each $R_4$ or $R_5$ is the same or different and is a straight or branched alkylene radical containing from 1 to 4 carbon atoms, each $R_6$ is the same or different and is a methyl or ethyl group, each $R_7$ is the same or different and is an ethylene or propylene group and y is an integer from 1 to 8, preferably an integer such that the total number of carbon atoms in the $\text{-}(R_7O)\text{-}$ group is from 4 to 12.

Glycol ortho ester hydraulic fluid components known and used in conventional fluids are such glycol ortho esters of the formula

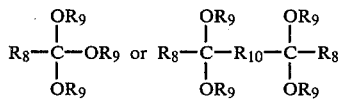

wherein each $R_8$ is a hydrogen atom, an alkyl radical containing from 1 to 5 carbon atoms, or the same as $R_9$; each $R_9$ is the same or different and each is an alkyl radical containing from 1 to 4 carbon atoms, an oxyalkylene glycol monoether radical, or a polyoxyalkylene glycol monoether radical containing from 2 to 20 alkylene oxyunits; and $R_{10}$ is an alkylene radical containing from 1 to 12 carbon atoms.

Numerous varieties of borate ester hydraulic fluid components are known. These may be depicted by the following formulas:

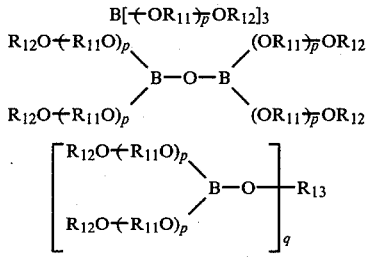

-continued

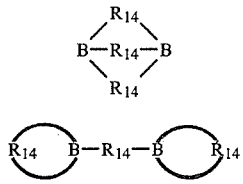

wherein each $R_{11}$ is the same or different and is a straight or branched $C_{2-4}$ alkylene group, each $R_{12}$ is the same or different and is hydrogen or a $C_{1-4}$ alkyl group, each p is the same or different and is an integer of from 1 to 10, q is an integer of from 2 to 6, $R_{13}$ is the residue of a di- or polyhydroxy organic compound having a number of reactive hydroxy groups equal to q, and each $R_{14}$ is the same or different and is the residue of a dihydroxy organic compound which residue is attached to each boron atom via an oxygen atom.

A mixture of such borate ester compounds together with compounds containing reactive hydroxyl functionality generally results by means of alkoxide exchange in production of an equilibrium mixture of such compounds in the resulting hydraulic fluid.

The foregoing list of known conventional hydraulic fluid components are more fully described in U.S. Pat. No. 4,093,554 to which reference may be made for further details.

Suitable silicone conventional hydraulic fluids are the monomeric or polymeric organo silane or organosiloxane compounds including such compounds that are substituted with compatible substituents, e.g., alkyl-, aryl-, alkoxy-, aryloxy-, alkylene-, alkylenedioxy-, (poly)oxyalkylene-, cyano-, cyanoalkyl-, hydroxyalkyl-, carbonyl-, etc., or mixtures thereof.

These silicone hydraulic fluid components are well-known. Suitable compounds have been described in numerous references of the prior art, for example, U.S. Pat. Nos. 2,129,281; 2,449,335; 2,836,611; 2,837,552; 3,507,898; 3,821,114; 4,005,023; 4,075,115; and 4,088,591 which teachings are incorporated herein by reference.

Hydraulic fluid compositions comprising the above-described silicone fluids and the cyano-substituted compounds have been found to be very stable and resistant to separation or crystallization at high or low temperatures and to possess improved viscosity characteristics.

Particularly preferred conventional hydraulic fluid components are (poly)alkylene glycols, especially polypropylene glycols having a molecular weight from about 500 to about 2000. Particularly high boiling hydraulic fluids according to the invention may include such polypropylene glycol components.

Among the various types of additives which can be added to the hydraulic fluids of this invention are included: inhibitors for pH and corrosion control, antioxidants, viscosity index improvers, pour point depressants, lubricity agents, antifoamants, stabilizers demulsifiers, dyes and odor suppressants. Generally, the total amount of additives which may be incorporated into the fluid composition will vary depending on the particular composition and the desired properties.

As conventionally used additives of hydraulic fluids in order to inhibit oxidation of the organic compounds at high temperatures may be named the antioxidants diarylamines, e.g., diphenylamine, p,p'-dioctyldiphenylamine, phenyl-α-naphthylamine, or phenyl-β-naphthylamine. Other suitable antioxidants are those commonly known as hindered phenols exemplified by:
2,4-dimethyl-6-t-butyl phenol
2,6-ditertiarybutyl-4-methyl phenol
2,6-di-t-butyl phenol
1,1-bis(3,5-di-t-butyl-4-hydroxyphenyl)methane
3,3',5,5'-tetra-t-butyl-4,4'-dihydroxydiphenyl-3-methyl-4,6-di-t-butyl phenol
4-methyl-2-t-butyl phenol Yet further additives which may be used are phenothiazine and its derivatives, for example those having alkyl, or aryl groups attached to the nitrogen atom or to the aryl groups of the molecule.

Conventional lubricity additives usefully added to hydraulic fluids include high molecular weight monoethers of polyalkylene glycols, for example, such monoalkyl ethers of polypropylene glycol of 500 or higher molecular weight; mineral oil; and castor oil derivatives, e.g., blown caster oil (caster oil blown with air or oxygen while being heated), castor oil treated with ethylene oxide or propylene oxide.

Other lubricity additives conventionally known include borate esters, e.g., tricresyl borate and borate ester condensates; and phosphorus-containing esters, especially phosphates, e.g., tricresyl phosphate.

Other lubricity agents are orthophosphate or sulfate salts of primary or secondary aliphatic amines having a total of from 4 to 24 carbon atoms, dialkyl citrates having an average of from 3.5 to 13 carbon atoms in the alkyl groups, aliphatic dicarboxylic acids and esters thereof, specific examples being
diamylamine orthophosphate
dinonylamine orthophosphate
diamylamine sulfate
dinonyl citrate
di(2-ethyl hexyl)citrate
polyoxyethylene sebacate derived from a polyoxyethylene glycol of M.W. 200
polyoxyethylene azelate derived from a polyoxyethylene glycol of M.W. 200
polyoxyethylene adipate derived from a polyoxyethylene glycol of M.W. 200
polyoxyethylene/polyoxypropylene glutarate derived from mixed polyoxyglycols of average M.W. of about 200
diethyl sebacate
di-2-ethyl hexyl sebacate
diisooctyl azelate Corrosion inhibitors which may be used in the present invention may be selected from heterocyclic nitrogen-containing compounds, e.g., benzotriazole and benzotriazole derivatives or mercapto benzothiazole. Many amines or derivatives thereof are also suitable as corrosion inhibitors, for example:
di-n-butylamine
di-n-amylamine
cyclohexylamine
morpholine
triethanolamine
and soluble salts thereof, e.g., cyclohexylamine carbonate.

Phosphites are also good corrosion inhibitors, e.g.:
triphenyl phosphite
diisopropyl phosphite
and certain inorganic salts may be incorporated, e.g., sodium nitrate.

The preceding list of known conventional additives for hydraulic fluids are more fully described in U.S. Pat. No. 4,093,554 to which reference may be made for further details.

The various compounds, cyano-substituted cyclic compounds of formula I, components and additives are formulated into the invented hydraulic fluid by adding the compounds in any order and agitating the resulting mixture until a uniform, homogeneous composition results. Heating to a slightly elevated temperature may be employed as an aid in formulation of the invented hydraulic fluid.

SPECIFIC EMBODIMENTS

The following examples illustrate various embodiments of the present invention, but the present invention should not be construed to be limited thereto.

EXAMPLES 1–4

5-Oxohexane nitrile was purified by extracting a 33 percent ether solution with a 5 percent aqueous HCl solution to remove basic impurities. The ether fraction was dried, filtered and the ether solvent removed by evaporation. Analysis by gas chromatography indicated 5-oxohexane nitrile in 99.8 percent purity remained.

The ketalization reaction of 5-oxohexane nitrile (OHN) with the following hydroxyl-containing compounds was accomplished by refluxing the reactants in the presence of p-toluene sulfonic acid catalyst and toluene solvent in a three-necked glass flask topped with a Dean-Stark trap and a reflux condenser for azeotropic removal of water. The reaction was continued for the stated time period. Upon completion of the reaction, the solutions were cooled, basified to pH of 7.5–8.0 by addition of solid $NaHCO_3$, filtered and distilled. Analysis by gas chromatograph determined the ketal as the only product formed in all cases. Yields after distillation were from 60–75 percent.

| Example | Name | Hydroxyl Reactant moles | OHN moles | Catalyst moles | Reaction Time (hr) | % Conversion |
|---|---|---|---|---|---|---|
| 1 | 2-(3-cyanopropyl)-2-methyl-1,3-dioxolane | ethylene glycol 4.0 | 3.24 | 0.003 | 24 | 98.5 |
| 2 | 2-(3-cyanopropyl)-2,4-dimethyl-1,3-dioxolane | propylene glycol 3.1 | 3.0 | 0.003 | 48 | 99.3 |
| 3 | 2-(3-cyanopropyl)-2-methyl-4-hydroxymethyl-1,3-dioxolane | glycerine 2.7 | 3.3 | 0.003 | 48 | 98.7 |
| 4 | 2-(3-cyanopropyl)-2-methyl-1,3-dioxane | 1,3-propanediol 3.1 | 3.0 | 0.003 | 48 | 99.6 |

The compounds prepared above were tested for use as components in a hydraulic fluid. Results of this testing are contained in Table I.

EXAMPLES 5–8

2-(2-Cyanoethyl)-4-methyl-1,3-dioxolane

Anhydrous hydrogen chloride was bubbled into a solution of about 304 g of propylene glycol and 300 ml chloroform cooled to a temperature of −14° C. While maintaining a slight positive pressure, 168 g of acrolein was added dropwise with stirring over a 90-minute period. The temperature was maintained below −10° C. and the hydrogen chloride addition continued with stirring for an additional hour.

When stirring was finally ceased and the temperature allowed to slowly increase to room temperature a cloudy suspension remained which separated into two layers. The lower layer, containing 2-(2-chloroethyl)-4-methyl-1,3-dioxolane, was drawn off, partially neutralized with 3 ml of triethylamine and washed with 50 ml of saturated sodium carbonate solution. The organic layer was again separated, dried over calcium sulfate and heated in vacuo to remove residual acrolein and chloroform. Final vacuum distillation yielded 221 g of 2-(2-chloroethyl)-4-methyl-1,3-dioxolane, bp. 39°–41° C. @ 0.05 torr.

This compound (190 g) was then combined in 500 ml of ethylene glycol monomethyl ether and sodium cyanide (64 g) and refluxed at 125° C. for about 7 hours. Additional sodium cyanide (11 g) was added and refluxing continued for 3 more hours. The mixture was cooled and the salt separated by filtration. Concentration and vacuum distillation of the filtrate gave about 140 g of a colorless liquid 2-(2-cyanoethyl)-4-methyl-1,3-dioxolane, bp. 65°–67° C. @ 0.05 torr.

Substantially repeating the above reaction conditions, additional compounds were also prepared. Names of the compounds and the reactants employed are provided in the following list:

| Example | Compound | Polyhydroxy Reactant | Ethylenically Unsaturated Aldehyde |
|---|---|---|---|
| 5 | 2-(2-cyanoethyl)-4-methyl-1,3-dioxolane | propylene glycol | acrolein |
| 6 | 2-(2-cyanoethyl)-1,3-dioxolane | ethylene glycol | acrolein |
| 7 | 2-(2-cyanoethyl)-2-methyl-1,3-dioxolane mixture: | ethylene glycol | methylvinyl ketone |
| 8 | 2-(2-cyanoethyl)-4-hydroxymethyl-1,3-dioxolane/ 2-(2-cyanoethyl)-5-hydroxy-1,3-dioxane* | glycerine | acrolein |

-continued

*The percentage of each component in the mixture was not determined.

The following Table I indicates the properties possessed by the compounds prepared according to Examples 1 through 8.

TABLE I[a]

| Example | ERBP °C. Dry | ERBP °C. Wet | Dry Viscosity −40° C. (cSt) | Rubber Cup Swelling (mm) | Rubber Cup −Δ Hardness IRHD (120° C.) | Stability Δ° C. Chemical | Stability Δ° C. Thermal |
|---|---|---|---|---|---|---|---|
| 1 | 249 | 170 | 324 | 2.18 | 14 | <1.0 | — |
| 2 | 248 | 170 | 769 | 3.43 | 19 | 0 | — |
| 3 | 329 | 199 | >6000 | 0.02 | 2 | <1.0 | <1.0 |
| 4 | 268 | 181 | 5112 | 4.16 | 17 | 2.0 | 2.0 |
| 5 | 231 | 173 | 108 | 1.57 | 9 | 0 | 0 |
| 6 | 233 | 174 | solid | 0.84 | 8 | 0 | <1.0 |
| 7 | — | 175 | solid | 1.47 | 10 | — | — |
| 8 | — | 208 | >6000 | −.127 | 3 | — | — |
| 6 + 8 (70%/30%) | — | 184 | 619 | — | — | — | — |
| DOT 3 | 205 | 140 | 1500 max. | 1.40 max. | 15 max. | 3.0 max. | 3.0 max. |
| DOT 4 | 230 | 155 | 1800 max. | 1.40 max. | 15 max. | 3.0 max. | 3.0 max. |
| DOT 5 | 260 | 180 | 900 max. | 1.40 max. | 15 max. | 3.0 max. | 3.0 max. |

[a]Tests were conducted according to Federal Motor Vehicle Safety Standard No. 116, 40 CFR 571.116 except where sample limitations prevented testing of all categories.

What is claimed is:

1. A hydraulic fluid composition comprising a cyano-substituted cyclic compound of from 5 to 20 carbons of the formula,

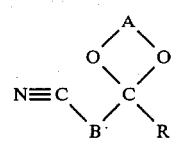

wherein:

R is hydrogen or a monovalent radical of from 1 to 10 carbons selected from branched or linear alkyl and cyano-, hydroxy-, alkoxy-, acyloxy-, siloxy- or organosiloxy-substituted derivatives thereof;

A is a divalent radical of from 2 to 10 carbons selected from alkylene and alkyl-, aryl-, cyano-, hydroxy-, cyanoalkyl-, hydroxyalkyl-, alkoxy-, polyalkoxy-, acyloxy-, siloxy- or organosiloxy-substituted alkylene; and B is a divalent radical of from 2 to 10 carbons selected from the group consisting of branched or linear alkylene, and $$\left(CH_2\right)_m\left(OCH_2-\underset{\substack{|\\ R'_1}}{CH}\right)_n$$

wherein $R'_1$ is each occurrence hydrogen, methyl or ethyl and m and n are integers equal to or greater than 1; and a remainder comprising at least one compound selected from the group consisting of cyano-substituted cyclic compounds of the above formula but different than the above cyano-substituted cyclic compound, hydraulic fluid components and hydraulic fluid additives.

2. A hydraulic fluid composition as claimed in claim 1 wherein the cyano-substituted cyclic compound or mixture thereof is present in a concentration of at least about 5 percent by weight.

3. A hydraulic fluid composition as claimed in claim 2 consisting essentially of the indicated parts by weight of the following:

(a) from about 10 percent to about 90 percent of one or more of the cyano-substituted cyclic compounds;

(b) from about zero to about 90 percent of one or more hydraulic fluid components; and (c) from about zero to about 10 percent of one or more hydraulic fluid additives.

4. A hydraulic fluid composition as claimed in claim 3 wherein the hydraulic fluid components and additives are conventional hydraulic fluid components and additives.

5. A hydraulic fluid composition as claimed in claim 4 wherein the conventional hydraulic fluid component is selected from:

(a) a polyalkylene glycol of the formula HO—R'O—$_n$H wherein R' is each occurrence the same or different and is a linear or branched $C_{1-6}$ alkylene and n is a positive number up to about 50;

(b) a polyglycol mono- or diether or polyglycol formal of the formula $R'_1O(R'O)_nR_2$ or $R'_1O(R'O)_n—CH_2(OR')_nOR_2$ wherein R' and n are as previously defined, $R'_1$ is hydrogen, $C_{1-4}$ linear or branched alkyl or phenyl, and $R_2$ is $C_{1-4}$ linear or branched alkyl or phenyl;

(c) a glycol ester of the formula

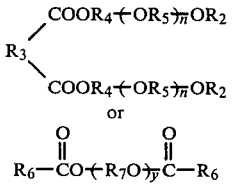

wherein n and $R_2$ are as previously defined, $R_3$ is straight or branched $C_{2-8}$ alkylene, each $R_4$ or $R_5$ in each occurrence is the same or different and is a straight- or branched-chain $C_{1-4}$ alkylene, $R_6$ is each occurrence $C_{1-2}$ alkyl, $R_7$ is each occurrence $C_{2-3}$ alkylene and y is an integer from 1 to 8;

(d) a glycol orthoester of the formula

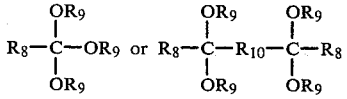

wherein $R_8$ is each occurrence hydrogen, $C_{1-5}$ alkyl or $R_9$, $R_9$ is each occurrence $C_{1-4}$ alkyl, an oxyalkylene glycol monoether radical or polyoxyalkylene glycol monoether radical of from 2 to 20 oxyalkylene units, and $R_{10}$ is $C_{1-12}$ alkylene;

(e) a borate ester of the formula

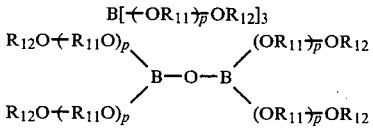

-continued

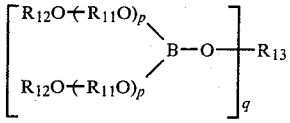

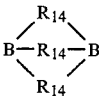

or

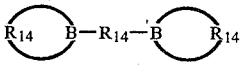

wherein $R_{11}$ is each occurrence straight or branched $C_{2-4}$ alkylene, $R_{12}$ is each occurrence hydrogen or $C_{1-4}$ alkyl, p is each occurrence an integer from 1 to 10, q is an integer from 2 to 6, $R_{13}$ is the residue of a di- or polyhydroxy organic compound having a number of reactive hydroxy groups equal to q, and $R_{14}$ is each occurrence the residue of a dihydroxy organic compound which residue is attached to each boron atom via an oxygen atom;

(f) monomeric or polymeric organosilanes or organosiloxanes or such compounds substituted with alkyl-, aryl-, alkoxy-, aryloxy-, alkylene-, oxyalkylene-, alkylenedioxy-, polyoxyalkylene-, cyano-, cyanoalkyl-, hydroxyalkyl- or carbonyl- substituents or mixtures thereof; and (g) mixtures of (a) through (f).

6. A hydraulic fluid composition as claimed in claim 5 wherein the conventional hydraulic fluid component is a (poly)alkylene glycol or a mixture thereof.

7. A hydraulic fluid composition as claimed in claims 1, 3, 5 or 6 wherein the cyano-substituted cyclic compound is selected from 2-(2-cyanoethyl)-1,3-dioxolane, 2-(3-cyanopropyl)-1,3-dioxolane, 2-(2-cyanoethyl)-2-methyl-1,3-dioxolane, 2-(3-cyanopropyl)-2-methyl-1,3-dioxolane, 2-(2-cyanoethyl)-4-hydroxymethyl-1,3-dioxolane, 2-(3-cyanopropyl)-4-hydroxymethyl-1,3-dioxolane, 2-(2-cyanoethyl)-2-methyl-4-hydroxymethyl-1,3-dioxolane, 2-(3-cyanopropyl)-2-methyl-4-hydroxymethyl-1,3-dioxolane, 2-(2-cyanoethyl)-4-methyl-1,3-dioxolane 2-(3-cyanopropyl)-4-methyl-1,3-dioxolane, 2-(2-cyanoethyl)-2,4-dimethyl-1,3-dioxolane, 2-(3-cyanopropyl)-2,4-dimethyl-1,3-dioxolane, 2-(2-cyanoethyl)-5-hydroxyl-1,3-dioxane, 2-(3-cyanopropyl)-5-hydroxyl-1,3-dioxane, and mixtures thereof.

8. A hydraulic fluid composition as claimed in claim 7 wherein the cyano-substituted cyclic compound is selected from 2-(2-cyanoethyl)-1,3-dioxolane, 2-(2-cyanoethyl)-4-methyl-1,3-dioxolane, 2-(2-cyanoethyl)-4-hydroxymethyl-1,3-dioxolane, 2-(2-cyanoethyl)-5-hydroxy-1,3-dioxane, and a mixture thereof.

9. In the operation of a fluid pressure operating device which uses hydraulic pressure transmission fluid, the improvement comprising using as said hydraulic pressure transmission fluid a composition comprising a cyano-substituted cyclic compound of from 5 to 20 carbons of the formula

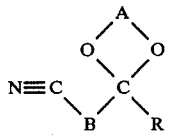

or a mixture thereof, wherein:

R is hydrogen or a monovalent radical of from 1 to 10 carbons selected from branched or linear alkyl and cyano-, hydroxy-, alkoxy-, acyloxy-, siloxy-, or organosiloxy-substituted derivatives thereof;

A is a divalent radical of from 2 to 10 carbons selected from alkylene and alkyl-, aryl-, cyano-, hydroxy-, cyanoalkyl-, hydroxyalkyl-, alkoxy-, polyalkoxy-, acyloxy-, siloxy- or organosiloxy-substituted alkylene; and B is a divalent; radical of from 2 to 10 carbons selected from the group consisting of branched or linear alkylene, and $$\text{-}(CH_2)_m\text{-}(OCH_2\text{-}\underset{\underset{R'_1}{|}}{CH})_n\text{-}$$

wherein $R'_1$ is each occurrence hydrogen, methyl or ethyl and m and n are integers equal to or greater than 1.

* * * * *

UNITED STATES PATENT AND TRADEMARK OFFICE

CERTIFICATE OF CORRECTION

PATENT NO. : 4,320,024

DATED : March 16, 1982

INVENTOR(S) : Robert L. Reierson, Bart J. Bremmer, Joseph W. Hanafin & Hugh Franklin Hussey It is certified that error appears in the above—identified patent and that said Letters Patent is hereby corrected as shown below:

Title page, Inventors section, "Robert L. Reierson, Midland, Mich.; Bart J. Bremmer, Ashland; Joseph W. Hanafin, Framingham, both of Mass." should read -- Robert L. Reierson, Midland, Mich.; Bart J. Bremmer, Ashland; Joseph W. Hanafin, Framingham, both of Mass.; Hugh Franklin Hussey, Midland, Mich. --.

Column 5, formula-line 43, "$R_8-\underset{OR_9}{\overset{OR_9}{C}}-R_{10}-\underset{OR_9}{\overset{OR_9}{C}}-R_8$" should read --

$$R_8-\underset{OR_9}{\overset{OR_9}{C}}-OR_{10}O-\underset{OR_9}{\overset{OR_9}{C}}-R_8$$ --.

Column 6, line 59, "stabilizers demulsi-" should read -- stabilizers, demulsi- --.

Column 7, line 19, "caster oil (caster" should read -- castor oil (castor --.

Column 10, line 28, "40 CFR 571.116" should read -- 49 CFR § 571.116 --.

Column 11, lines 22 & 23, "$HO-R-'O-_nH$" should read -- $HO\{R-'O\}_nH$ --.

Column 11, line 27, "$R'_1O\{R'O-_nR_2$ or $R'_1O-R-$" should read -- $R'_1O\{R'O\}_nR_2$ or $R'_1O\{R-$ --.

UNITED STATES PATENT AND TRADEMARK OFFICE

CERTIFICATE OF CORRECTION

PATENT NO. : 4,320,024

DATED : March 16, 1982

INVENTOR(S) : Robert L. Reierson, Bart J. Bremmer, Joseph W. Hanafin and Hugh Franklin Hussey It is certified that error appears in the above—identified patent and that said Letters Patent is hereby corrected as shown below:

Column 11, line 53-formula, "$R_8-\overset{\overset{OR_9}{|}}{\underset{\underset{OR_9}{|}}{C}}-R_{10}-\overset{\overset{OR_9}{|}}{\underset{\underset{OR_9}{|}}{C}}-R_8$" should read --

$R_8-\overset{\overset{OR_9}{|}}{\underset{\underset{OR_9}{|}}{C}}-OR_{10}O-\overset{\overset{OR_9}{|}}{\underset{\underset{OR_9}{|}}{C}}-R_8$ --.

Column 12, line 50, "lane 2-(3-cyanopropyl)" should read -- lane, 2-(3-cyanopropyl) --.

Column 14, line 3, "B is a divalent; radical" should read -- B is a divalent radical --.

Signed and Sealed this

Thirteenth Day of July 1982

[SEAL]

Attest:

GERALD J. MOSSINGHOFF

Attesting Officer

Commissioner of Patents and Trademarks